US010939708B1

(12) United States Patent
Fink

(10) Patent No.: US 10,939,708 B1
(45) Date of Patent: Mar. 9, 2021

(54) UNDERWIRE FOR BRASSIERE

(71) Applicant: S&S Industries Ltd., Cheung Sha Wan (CN)

(72) Inventor: Matthew Fink, Weston, MA (US)

(73) Assignee: S&S Industries Ltd., Hong Kong (CN)

( * ) Notice: Subject to any disclaimer, the term of this patent is extended or adjusted under 35 U.S.C. 154(b) by 0 days.

(21) Appl. No.: 16/524,699

(22) Filed: Jul. 29, 2019

(51) Int. Cl.
*A41C 3/12* (2006.01)

(52) U.S. Cl.
CPC ..... *A41C 3/128* (2013.01)

(58) Field of Classification Search
CPC ..... A41C 3/122; A41C 3/124; A41C 3/126; A41C 3/0007; A41C 1/12; A41C 1/14
USPC ..... 450/41, 42, 47, 51, 52
See application file for complete search history.

(56) References Cited

U.S. PATENT DOCUMENTS 2,759,190 A * 8/1956 Herbener ..... A41C 3/06 450/41
2,762,055 A * 9/1956 Bermueller ..... A41C 3/126 450/51
2,799,021 A * 7/1957 La Bue ..... A41C 3/06 450/51
2,880,732 A * 4/1959 Smith ..... A41C 3/06 450/51
2,965,103 A * 12/1960 Blair ..... A41C 3/0007 450/42
3,140,494 A * 7/1964 Magidson ..... A41C 1/16 2/264
6,106,363 A * 8/2000 Werner ..... A41C 3/122 450/41
6,206,753 B1 * 3/2001 Werner ..... A41C 3/122 450/41

* cited by examiner

*Primary Examiner* — Gloria M Hale
(74) *Attorney, Agent, or Firm* — Pryor Cashman LLP

(57) ABSTRACT

An underwire for use in a brassiere, and the associated brassiere, the underwire including a generally arcuate base member having a first end, a central segment, and a second end, and a spiral boning member fixedly attached to the base member, where the spiral boning member has a greater flexibility than a flexibility of the base member.

8 Claims, 1 Drawing Sheet

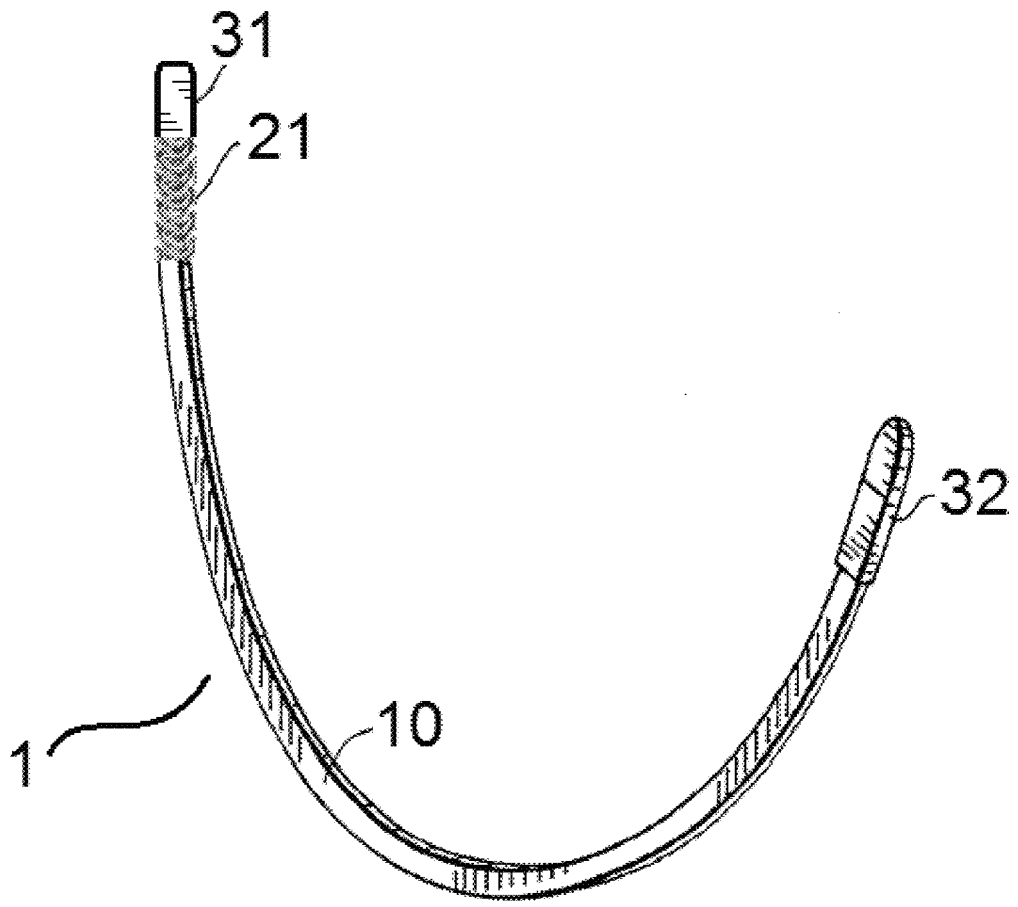
31
21
32
10
1

UNDERWIRE FOR BRASSIERE

TECHNICAL FIELD

The present invention relates generally to underwires, and particularly to underwires used in foundation garments such as brassieres.

BACKGROUND OF THE INVENTION

Underwires are components used to provide shape and support to brassieres and similar foundation garments. Underwires are typically rigid and flat, formed of steel, and have an arcuate configuration. Alternatively, underwires may be formed of hard, molded, or extruded plastic. Metal, plastic, or polymeric tips are often provided at one or both ends of the underwires.

When a garment having an underwire is worn, certain movements of the wearer, including turning, twisting, and bending of the torso, can cause the underwire to press into the wearer's body and produce discomfort. There is a need for an improved underwire that provides the requisite level of shape and support, and permits greater flexibility to lessen the pressing effects of the underwire.

SUMMARY OF THE INVENTION

In general, in one aspect, the invention features an underwire for use in a brassiere, including a generally arcuate base member having a first end, a central segment, and a second end, and a spiral boning member fixedly attached to the base member, where the spiral boning member has a greater flexibility than a flexibility of the base member.

Implementations of the invention may include one or more of the following features. The base member may include steel, stainless steel, or alloy steel. The spiral boning member may include steel, stainless steel, or alloy steel. The spiral boning member may be welded to the base member. The spiral boning member may be fixedly attached to the base member at the first end, the central segment, or the second end. The spiral boning member may be fixedly attached to the first end of the base member, and a second spiral boning member may be fixedly attached to the second end of the base member. The spiral boning member may be fixedly attached to the central segment of the base member, the base member being split at a location in the central segment, and the spiral boning member being disposed therein. A tip may be disposed on the spiral boning member. The tip may be a coating, and the tip may be a fused in-situ polymer or plastic. The tip may be a metal tip, a polymeric material tip, or a plastic tip mechanically inserted on the spiral boning member.

In general, in another aspect, the invention features a brassiere including at least one underwire including a generally arcuate base member having a first end, a central segment, and a second end, and a spiral boning member fixedly attached to the base member, where the spiral boning member has a greater flexibility than a flexibility of the base member.

Implementations of the invention may include one or more of the following features. The base member may include steel, stainless steel, or alloy steel. The spiral boning member may include steel, stainless steel, or alloy steel. The spiral boning member may be welded to the base member. The spiral boning member may be fixedly attached to the base member at the first end, the central segment, or the second end. The spiral boning member may be fixedly attached to the first end of the base member, and a second spiral boning member may be fixedly attached to the second end of the base member. The spiral boning member may be fixedly attached to the central segment of the base member, the base member being split at a location in the central segment, and the spiral boning member being disposed therein. A tip may be disposed on the spiral boning member. The tip may be a coating, and the tip may be a fused in-situ polymer or plastic. The tip may be a metal tip, a polymeric material tip, or a plastic tip mechanically inserted on the spiral boning member.

BRIEF DESCRIPTION OF THE DRAWINGS

The above-mentioned and other aspects, features, and advantages can be more readily understood from the following detailed description with reference to the accompanying drawings wherein:

FIG. 1 shows a perspective view of an underwire according to one embodiment of the present invention.

DETAILED DESCRIPTION OF THE INVENTION

The present invention provides an underwire for use in foundation garments including, but not limited to, brassieres. In a preferred embodiment, the underwire includes a generally planar base member and at least one spiral boning member fixedly attached to the base member. The base member may be curved so as to be generally arcuate. The spiral boning member may be attached or otherwise connected to one or both sides of the base member or included in a center portion of the base member. A tip may be included on one or both sides of the underwire, and attached or otherwise connected to the base member or the spiral boning member. Notably, in this arrangement including at least one spiral boning member, an end portion of the underwire may flex up to 360°.

The base member may be fabricated from steel, stainless steel, or steel that has been galvanized or otherwise coated. Aluminum and aluminum alloys, copper and copper alloys, steel alloys, and other types of metal can be used without limitation. Alternatively, the base member may be fabricated from various polymeric materials and engineering plastics. Suitable polymers, copolymers, and blends used for molding, extruding, and machining of underwires can include nylon, polyethylene, butadiene-styrene, acrylonitrile-butadiene-styrene, polycarbonates, polyvinyl chloride, and others. Desired physical properties can be provided and enhanced by reinforcing the polymers by addition of glass and carbon fibers to the liquid resins. Polymeric or plastic underwire bodies can be of any industry-accepted cross-sectional configuration and dimension.

The spiral boning member may be fabricated from metal, polymeric material, or plastic, including those types of metal, polymeric material, and plastic described with respect to the base member. The spiral boning member may be composed of a flattened continuous spring structure. The construction of the spiral boning member permits high flexibility in all directions.

The tip may be a coating or a separately-formed component, i.e., a component molded and/or machined from metal, polymeric material, or plastic having a composition commonly used for such purposes. The tip may be a powder coating. The tip may be a fused in-situ polymer or plastic tip. The coating may be applied to one or more spiral boning members or base member end portions of the underwire. The separately-formed tip component may be formed from metal, polymeric material, or plastic. The separately-formed tip component may be mechanically inserted, mounted, or otherwise attached to one or more spiral boning members or base member end portions of the underwire.

In the embodiment of FIG. 1, an underwire 1 includes a base member 10, a spiral boning member 21, a first tip 31, and a second tip 32. Base member 10 is generally flat with a rounded edge or oval-shaped cross-section and curved to have a generally arcuate shape. Spiral boning member 21 is attached to a first end of base member 10. In this embodiment, only one spiral boning member, spiral boning member 21, is included in the underwire 1, and accordingly, the spiral boning member is disposed on only one end of base member 10. In other embodiments, a spiral boning member is disposed on one or both ends of base member 10 and/or in a center portion of base member 10. Spiral boning member 21 may be fixedly attached to base member 10 by any industry-accepted joining or affixing process, such as welding.

First tip 31 is disposed on an end of spiral boning member 21 that is opposite to the end of member 21 attached to base member 10. Second tip 32 is disposed on a second end of base member 10. First tip 31 and second tip 32 may have rounded outer edges and a thickness greater than that of base member 10 or spiral boning member 21. In alternative embodiments, underwire 1 may only include one or none of first tip 31 and second tip 32. One or both of first tip 31 and second tip 32 may be formed of a coating, a metal component, a polymeric material component, or a plastic component.

In the embodiments of the present invention, including the embodiment of FIG. 1, the underwire may be encapsulated in or covered by a coating, a sheath, or other covering. The covering may be disposed on the base member-spiral boning member assembly to cover the assembly. The same or different covering may be disposed on the tips incorporated with the underwire to cover the incorporated tips. The selected covering may be any industry-accepted covering.

The embodiments and examples above are illustrative, and many variations can be introduced to them without departing from the spirit of the disclosure or from the scope of the appended claims. For example, elements and/or features of different illustrative and exemplary embodiments herein may be combined with each other and/or substituted with each other within the scope of this disclosure. The objects of the invention, along with various features of novelty that characterize the invention, are pointed out with particularity in the claims annexed hereto and forming a part of this disclosure. For an understanding of the invention, its operating advances and the specific objects attained by its uses, reference should be had to the accompanying drawings and descriptive matter in which there is illustrated a preferred embodiment of the invention.

What is claimed is:

1. An underwire for use in a brassiere, comprising:

a generally arcuate base member having a first end, a central segment, and a second end;

a spiral boning member fixedly attached to the base member; and a tip disposed on the spiral boning member;

wherein the spiral boning member has a greater flexibility than a flexibility of the base member.

2. The underwire of claim 1, wherein the base member comprises steel, stainless steel, or alloy steel.

3. The underwire of claim 1, wherein the spiral boning member comprises steel, stainless steel, or alloy steel.

4. The underwire of claim 1, wherein the spiral boning member is welded to the base member.

5. The underwire of claim 1, wherein the spiral boning member is fixedly attached to the base member at the first end.

6. The underwire of claim 1, wherein the tip is a coating on the spiral boning member.

7. The underwire of claim 6, wherein the tip is a fused in-situ polymer or plastic.

8. The underwire of claim 1, wherein the tip is a metal tip, a polymeric material tip, or a plastic tip mechanically inserted on the spiral boning member.

* * * * *